US007640779B2

(12) United States Patent
Sasahara

(10) Patent No.: US 7,640,779 B2
(45) Date of Patent: Jan. 5, 2010

(54) HOLDER UNIT AND HEMMING APPARATUS HAVING THE HOLDER UNIT

(75) Inventor: Tadashi Sasahara, Fujisawa (JP)

(73) Assignee: Oiles Corporation, Tokyo (JP)

( * ) Notice: Subject to any disclaimer, the term of this patent is extended or adjusted under 35 U.S.C. 154(b) by 580 days.

(21) Appl. No.: 10/549,446

(22) PCT Filed: Mar. 10, 2004

(86) PCT No.: PCT/JP2004/003123

§ 371 (c)(1),
(2), (4) Date: Sep. 14, 2005

(87) PCT Pub. No.: WO2004/087347

PCT Pub. Date: Oct. 14, 2004

(65) Prior Publication Data

US 2006/0168789 A1 Aug. 3, 2006

(30) Foreign Application Priority Data

Mar. 31, 2003 (JP) ..... 2003-095405

(51) Int. Cl.
*B21D 5/01* (2006.01)
*B21D 37/08* (2006.01)

(52) U.S. Cl. ..... 72/452.9; 72/315; 100/266; 100/291; 83/588

(58) Field of Classification Search ..... 72/297, 72/313, 315, 387, 388, 452.9; 100/266, 291; 83/588

See application file for complete search history.

(56) References Cited

U.S. PATENT DOCUMENTS

| | | | | |
|---|---|---|---|---|
| 5,341,669 | A * | 8/1994 | Katz | 72/387 |
| 5,881,599 | A * | 3/1999 | Sasahara et al. | 72/452.9 |
| 6,230,536 | B1 * | 5/2001 | Matsuoka | 72/313 |
| 6,250,177 | B1 * | 6/2001 | Sasahara | 72/381 |
| 6,336,399 | B1 * | 1/2002 | Matsuoka | 72/452.9 |
| 6,619,095 | B2 * | 9/2003 | Matsuoka | 72/452.9 |

(Continued)

FOREIGN PATENT DOCUMENTS

JP 60-184493 A 9/1985

(Continued)

OTHER PUBLICATIONS

International Search Report of PCT/JP2004/003123, mailed Jun. 22, 2004.

(Continued)

*Primary Examiner*—David B Jones
(74) *Attorney, Agent, or Firm*—Nixon & Vanderhye P.C.

(57) ABSTRACT

A hemming apparatus (1) includes a holder unit (2), a lower die (3) on which the holder unit (2) is installed, and an upper die (4) which is installed on the lower die (3) vertically movably. The holder unit (2) includes a base (5) secured to the lower die (3) by means of bolts or the like; a working tool holder (7) which is rotatably supported on the base (5) so that a hemming punch (6) can be disposed at a nonworking position and a working position; and a resilient means (8) for resiliently urging the working tool holder (7) so as to dispose the hemming punch (6) at the nonworking position.

46 Claims, 13 Drawing Sheets

U.S. PATENT DOCUMENTS

| | | | | |
|---|---|---|---|---|
| 6,983,634 | B2 * | 1/2006 | Chun et al. | 72/387 |
| 6,986,296 | B2 * | 1/2006 | Miyaji et al. | 72/452.9 |
| 7,191,635 | B2 * | 3/2007 | Chun et al. | 72/315 |

FOREIGN PATENT DOCUMENTS

| | | | |
|---|---|---|---|
| JP | 2-30329 | A | 1/1990 |
| JP | 4-351227 | A | 12/1992 |
| JP | 8-39157 | A | 2/1996 |
| JP | 8-117876 | A | 5/1996 |
| JP | 2000-51971 | A | 2/2000 |
| JP | 2001-137947 | | 5/2001 |
| JP | 2002-316223 | A | 10/2002 |

OTHER PUBLICATIONS

Microfilm of the specification and drawings annexed to the request of Japanese Utility Model Application No. 58844/1986 (Laid-open No. 174721/1987), Nov. 6, 1987, p. 5, lines 11 to 14.

Microfilm Of The Specification And Drawings Annexed To The Request of Japanese Utility Model No. 12935/1986 (Laid-Open No. 127315/1987), Aug. 12, 1987.

Japanese Office Action for corresponding Japanese Application No. 2003-095405; Jul. 1, 2009, 2 pages.

CD-ROM of the specification and drawings annoxed to the request of Japanese Utility Model Application No. 13912/1992, 7 pages.

* cited by examiner

HOLDER UNIT AND HEMMING APPARATUS HAVING THE HOLDER UNIT

This application is the U.S. national phase of international application PCT/JP2004/003123 filed 10 Mar. 2004 which designated the U.S. and claims benefit of JP 2003-095405, filed 31 Mar. 2003, the entire contents of each of which are hereby incorporated by reference.

TECHNICAL FIELD

The present invention relates to a hemming apparatus for hemming an edge portion of an outer panel of a motor vehicle or the like by a working tool such as a hemming punch, and more particularly to a holder unit holding a working tool such as a hemming punch used in such a hemming apparatus.

BACKGROUND ART

Conventionally, in a holder unit of a hemming apparatus, a working tool holder holding a working tool is movably supported on a base so that the working tool can be disposed at a nonworking position and a working position. And, the movement of the working tool holder to the nonworking position of the working tool after working is normally effected by the resiliency of a resilient body such as a coil spring.

In this type of hemming apparatus, initial adjustment is performed on the mutual position between the working tool on the one hand, and a lower die and an upper die on the other hand. Since this initial adjustment is extremely difficult if the resiliency of the resilient body is being applied to the working tool holder, the initial adjustment is performed after temporarily demounting the resilient body from the holder unit. The resilient body is mounted again on the holder unit upon completion of the initial adjustment.

Incidentally, the demounting and mounting operation of such a resilient body involves complicated and troublesome operations including such as the disassembly and reassembly of the holder unit, as well as the removal of the working tool holder from the base and the reinstallation thereof on the base. Furthermore, in some type of holder unit, the operation of unloading and reloading the resilient body having powerful resiliency, particularly the coil spring, is required, with the result that the demounting and mounting operation of the resilient body becomes extremely dangerous.

The above-described problems are not limited to the initial adjustment and similarly occur in the case of readjustment as well.

The present invention has been devised in view of the above-described aspects, and its object is to provide a holder unit which, by making the resiliency of the resilient body small without demounting the resilient body, makes it possible to easily effect the initial adjustment and readjustment of the mutual position between the working tool on the one hand, and the lower die and the upper die on the other hand, and which makes it possible to demount and remount the resilient body easily and safely and to easily perform the assembly and reassembly thereof, as well as a hemming apparatus having this holder unit.

DISCLOSURE OF THE INVENTION

A holder unit in accordance with a first aspect of the present invention comprises: a base; a working tool holder which is movably supported on the base so that a working tool to be mounted can be disposed at a nonworking position and a working position; and resilient means for resiliently urging the working tool holder so as to dispose the working tool at the nonworking position. Here, the working tool holder is provided with a through hole having one end open at one end surface of the working tool holder and another end open at another end surface of the working tool holder, and the resilient means includes a resilient body disposed between the one end and the other end of the through hole, a resiliency receiving body which is detachably fixed to the working tool holder at one end side of the through hole and receives the resiliency of the resilient body, and an abutment body which is movably disposed in the working tool holder at another end side of the through hole, and which is adapted to abut against the base by the resiliency from the resilient body.

According to the holder unit in accordance with a first aspect, in the through hole having one end open at one end surface of the working tool holder and the other end open at the other end surface of the working tool holder, the resilient body is disposed between the one end and the other end, and the resiliency receiving body for receiving the resiliency of this resilient body is detachably fixed to the working tool holder at the one end side of the through hole. Therefore, the application of the resiliency of the resilient body to the abutment body can be decreased by loosening the fixation of the resiliency receiving body to the working tool holder or by removing the resiliency receiving body from the working tool holder. Thus, the working tool holder, which has been moved to dispose the working tool to the nonworking position, can be moved to dispose the working tool to the working position without being subjected to a large resistance due to the resiliency of the resilient body. As a result, the resiliency of the resilient body can be made small without removing the resilient body, and it is possible to easily effect the initial adjustment and readjustment of the mutual position between the working tool on the one hand, and the lower die and the upper die on the other hand. Furthermore, as a result of the fact that the resilient body can be simply inserted into and withdrawn from the working tool holder, the disassembly and reassembly can be performed easily.

In a preferred example, the resiliency receiving body has a threaded plug which is threadedly secured to the working tool holder at the one end of the through hole, as in the holder unit in accordance with a second aspect of the invention. In this case, it suffices if the holder unit has a screw threadedly secured to the working tool holder so as to prevent the threaded plug from coming off the one end of the through hole, as in the holder unit in accordance with a third aspect of the invention. As the threaded plug, it is possible to cite as a preferred example an annular or cylindrical threaded plug in which a thread is provided on its cylindrical outer peripheral surface, and which has in its central portion a hexagonal through hole or a hexagonal recess for fitting a rotating tool therein, and can be inserted in its entirety into the through hole. However, the threaded plug may be another one, such as a so-called bolt having an enlarged head. In addition, in another preferred example, the resiliency receiving body has a closure plate attached to the one end face of the working tool holder by means of a screw so as to close the one end of the through hole, as in the holder unit in accordance with a fourth aspect of the invention.

The abutment body may be adapted to slidably abut against the base. In this case, as in the holder unit in accordance with a fifth aspect of the invention, the abutment body may have a cylindrical body or a hollow cylindrical body which is movably disposed in the working tool holder at the other end side of the through hole and a sliding body which is integrally provided on the cylindrical body or the hollow cylindrical body and slidably abuts against the base. Here, the sliding body may be a projection which is integrally provided on the cylindrical body or the hollow cylindrical body, and in which a portion slidably abutting against the base has a semicircular arc-shaped surface or a semispherical surface. In addition, the abutment body may be adapted to roll on and abut against the base. In this case, as in the holder unit in accordance with a sixth aspect of the invention, the abutment body may have a cylindrical body or a hollow cylindrical body which is movably disposed in the working tool holder at the other end side of the through hole and a rotating body which is rotatably held by the cylindrical body or the hollow cylindrical body and rolls on and abuts against the base. Here, as in the holder unit in accordance with a seventh aspect of the invention, the rotating body may be constituted by a spherical body or a roller which is rotatably held by the cylindrical body or the hollow cylindrical body. If the abutment body is such an abutment body, a spherical body or a roller can be made to roll on and abut against the base, so that the frictional resistance can be favorably reduced.

As in the holder unit in accordance with an eighth aspect of the invention, the working tool holder may include a holder body which has the through hole and is rotatably supported on the base by means of a shaft member, and a cam roller attached to the holder body so as to abut against a cam driver. Alternatively, as in the holder unit in accordance with a ninth aspect of the invention, the working tool holder may include a holder body which has the through hole and is supported on the base in such a manner as to be movable in parallel by means of a pair of parallel link members. In the case of such a holder unit in accordance with the ninth aspect, one of the pair of parallel link members has a link body and a cam roller attached to the link body so as to abut against a cam driver. In addition, in the case of such a holder unit in accordance with the ninth aspect, the base, the link body, and another one of the pair of parallel link members, and the holder body constitute a parallel link mechanism, as in the holder unit in accordance with a 10th aspect of the invention.

In another preferred example, as in the holder unit in accordance with an 11th aspect of the invention, the working tool holder has the through hole and is supported on the base rotatably and movably in parallel by means of a coupling column member and a pair of parallel link members. In the holder unit in accordance with the 11th aspect, the coupling column member is rotatably coupled to the base by means of a shaft member, each of the pair of parallel link members is rotatably coupled to respective ones of the working tool holder and the coupling column member, and respective ones of the coupling column member and one of the pair of parallel link members have cam rollers which respectively abut against cam drivers. In the case of the holder unit in accordance with the 11th aspect of the invention, the working tool holder, the coupling column member, and the pair of parallel link members constitute a parallel link mechanism, as in the holder unit in accordance with a 12th aspect of the invention.

As in the holder unit in accordance with a 13th aspect of the invention, the holder unit in accordance with the 11th or 12th aspect may preferably further comprise a transmitting body interposed between the working tool holder and the coupling column member so as to transmit to the working tool holder the rotation of the coupling column member for disposing the working tool at the working position and to transmit to the coupling column member the rotation of the working tool holder by the resilient means for disposing the working tool to the nonworking position. In this case, as in the holder unit in accordance with a 14th aspect of the invention, the transmitting body may be secured to the coupling column member and slidably abut against the working tool holder.

As in the holder unit in accordance with a 15th aspect of the invention, the resilient body preferably has at least one of a coil spring, urethane rubber, and a gas spring. More preferably, the resilient body has a coil spring as n the holder unit in accordance with a 16th aspect of the invention.

According to the invention, it is possible to provide a holder unit which, by making the resiliency of the resilient body small without demounting the resilient body, makes it possible to easily effect the initial adjustment and readjustment of the mutual position between the working tool on the one hand, and the lower die and the upper die on the other hand, and which makes it possible to demount and remount the resilient body easily and safely to easily perform the assembly and reassembly thereof, as well as a hemming apparatus having this holder unit.

Hereafter, a description will be given of the present invention and the mode for carrying out the invention with reference to the preferred embodiments shown in the drawings. It should be noted that the present invention is not limited to these embodiments.

BEST MODE FOR CARRYING OUT THE INVENTION

Figure 1:
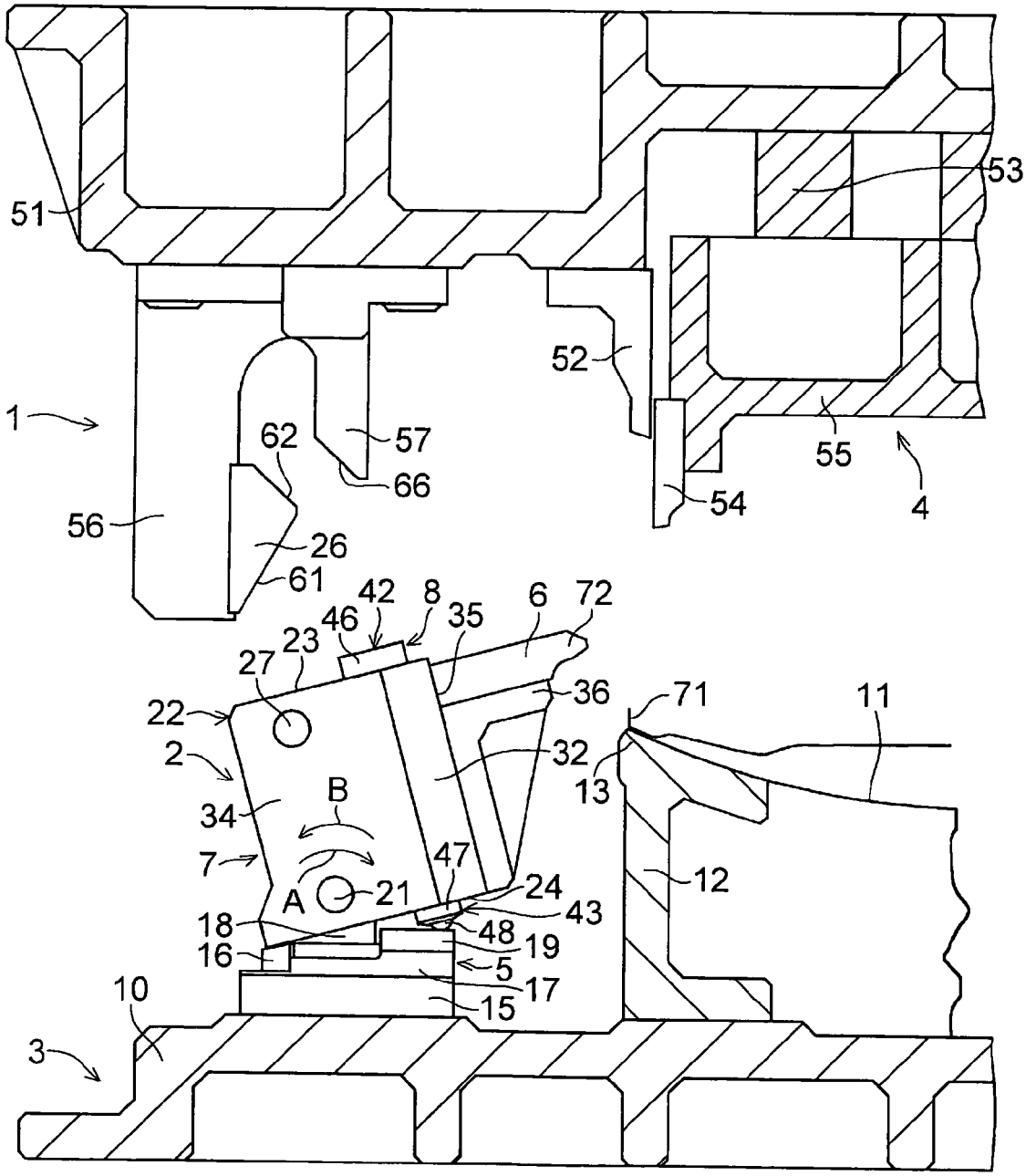
FIG. 1 is an explanatory cross-sectional view of a preferred embodiment of the invention.
Figure 2:
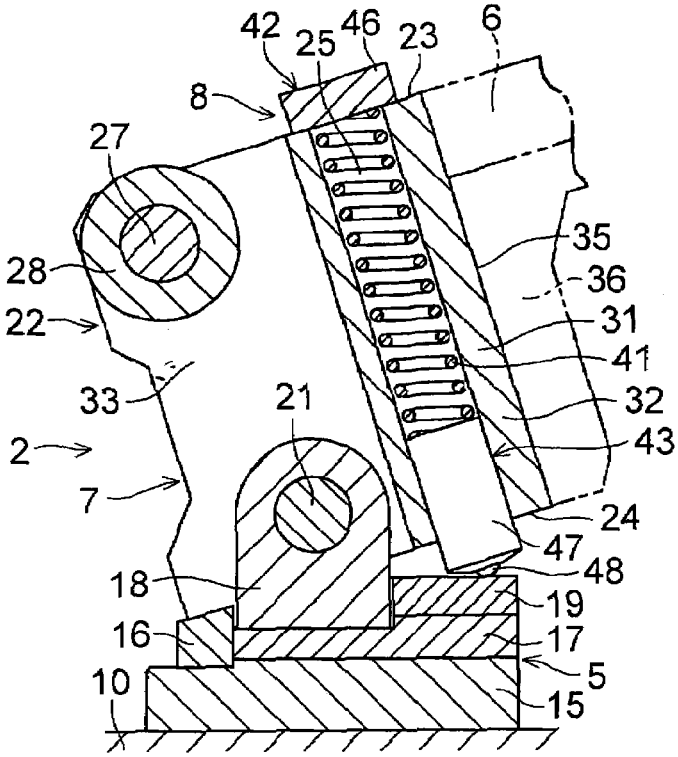
FIG. 2 is an explanatory cross-sectional view of a holder unit of the embodiment shown in FIG. 1.
Figure 3:
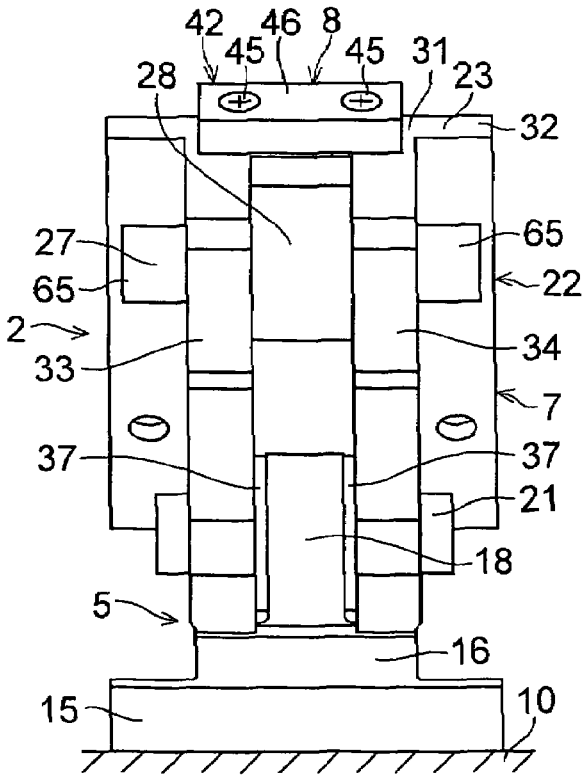
FIG. 3 is an explanatory left side view of the holder unit shown in FIG. 2.

In FIGS. 1 to 3, a hemming apparatus 1 in accordance with this embodiment is comprised of a holder unit 2, a lower die 3 on which the holder unit 2 is installed, and an upper die 4 which is installed above the lower die 3 vertically movably.

The holder unit 2 includes a base 5 secured to the lower die 3 by means of bolts or the like; a working tool holder 7 which is supported on the base 5 movably, i.e., rotatably in A and B directions in this embodiment, so that a hemming punch 6 as a working tool to be mounted can be disposed at a nonworking position (the, position shown in FIGS. 1 and 5) and a working position (the position shown in FIG. 4); and a resilient means 8 for resiliently urging the working tool holder 7 so as to dispose the hemming punch 6 at the nonworking position.

The fixed lower die 3 includes a base portion 10 as well as a lower die block 12 which is secured to the base portion 10 and on an upper surface of which an unworked plate (workpiece) 11 such as an outer panel of a motor vehicle serving as the workpiece is placed. In the lower die block 12, an edge portion 13 extending perpendicularly to the plane of the drawing of FIG. 1 is adapted to function as a hemming die.

The base 5 includes a base plate 15 secured to the base portion 10 of the lower die 3 by bolts or the like; a stopper member 16 and an intermediate plate 17 secured to the base plate 15 by bolts, welding, or the like; and a shaft supporting member 18 and a receiving plate 19 secured to the intermediate plate 17 by bolts, welding, or the like.

The working tool holder 7 includes a holder body 22 supported on the shaft supporting member 18 of the base 5 by means of a shaft member 21 rotatably in the A and B directions; a through hole 25 bored in the holder body 22 and having one end open at an upper surface 23, i.e., one end surface of the holder body 22, and the other end open at a lower surface 24, i.e., the other end surface of the holder body 22; and a cam roller 28 attached to the holder body 22 rotatably by means of a shaft member 27 so as to abut against a cam driver 26 installed on the upper die 4 on lowering of the upper die 4.

The holder body 22 includes a front plate portion 32 having a thick-walled portion 31, as well as a pair of side plate portions 33 and 34 formed integrally with the thick-walled portion 31 of the front plate portion 32 in such a manner as to oppose each other. The through hole 25 is bored in the thick-walled portion 31. The shaft members 21 and 27 are supported by the pair of side plate portions 33 and 34 in such a manner as to bridge the pair of side plate portions 33 and 34. The shaft supporting member 18 and the cam roller 28 are disposed between the pair of side plate portions 33 and 34. The hemming punch 6 is detachably mounted on a front surface 35 of the front plate portion 32 by means of a mounting tool 36 and bolts or the like. A thrust bearing 37 is disposed between each of the pair of side plate portions 33 and 34 and the shaft supporting member 18.

The resilient means 8 includes a coil spring 41 disposed between the one end and the other end of the through hole 25 and serving as a resilient body; a resiliency receiving body 42 which is detachably fixed to the holder body 22 of the working tool holder 7 at the one end side of the through hole 25, and is adapted to receive the resiliency of the coil spring 41; and an abutment body 43 which is disposed in the holder body 22 of the working tool holder 7 at the other end side of the through hole 25 movably along the direction in which the through hole 25 extends, and which is adapted to abut against the receiving plate 19 of the base 5 by the resiliency from the coil spring 41.

The resiliency receiving body 42 has a closure plate 46 which is attached to the upper surface 23 of the holder body 22 of the working tool holder 7 by means of screws 45 so as to close the one end of the through hole 25. The abutment body 43 has a cylindrical body 47 which is disposed in the holder body 22 of the working tool holder 7 at the other end side of the through hole 25 movably along the direction in which the through hole 25 extends, as well as a spherical body 48 rotatably held at a distal end portion of the cylindrical body 47 and serving as a rotating body which rolls on and abuts against the receiving plate 19 of the base 5.

The resilient means 8 constantly rotatively urges the working tool holder 7 in the B direction since the spherical body 48 abuts against the receiving plate 19 by the resiliency of the coil spring 41, and the closure plate 46 receives the resiliency of the coil spring 41. As a result, when the upper die 4 is raised, as shown in FIG. 1, the working tool holder 7 is rotated in the B direction, and abuts against the stopper member 16 at the side plate portions 33 and 34 of its holder body 22.

The upper die 4 which is capable of being raised and lowered includes a base portion 51 fixed-to a hydraulic ram or the like; an upper blade 52 secured to the base portion 51; an upper die block 55 which is supported by the base portion 51 by means of a resilient body 53 and to which a pressing member 54 is secured; a driver supporting member 56 which is secured to the base portion 51 and supports the cam driver 26; and a forcible-rotation guiding member 57 secured to the base portion 51.

The cam driver 26 has an inclined cam surface 61 which abuts against the cam roller 28 on lowering of the upper die 4 and rotates the holder body 22 in the A direction against the resiliency of the coil spring 41 by means of that cam roller 28, as well as an inclined cam surface 62 which abuts against the cam roller 28 on further lowering of the upper die 4 and guides the rotation of the holder body 22 in the B direction based on the resiliency of the coil spring 41 by means of that cam roller 28.

The forcible-rotation guiding member 57 has a pair of inclined cam surfaces 66. In a case where the holder body 22, after being rotated in the A direction by the inclined cam surface 61,while lowering of the upper die 4, fails to be rotated in the B direction by the resiliency of the coil spring 41 due to some cause or other, the inclined cam surfaces 66 abut against end portions 65 of the shaft member 27 projecting from the pair of side plate portions 33 and 34 and hence forcibly cause the rotation of the holder body 22 in the B direction due to the resiliency of the coil spring 41 by means of those end portions 65, thereby ensuring the guided rotation of the holder body 22 in the B direction by the inclined cam surfaces 62.

Figure 4:
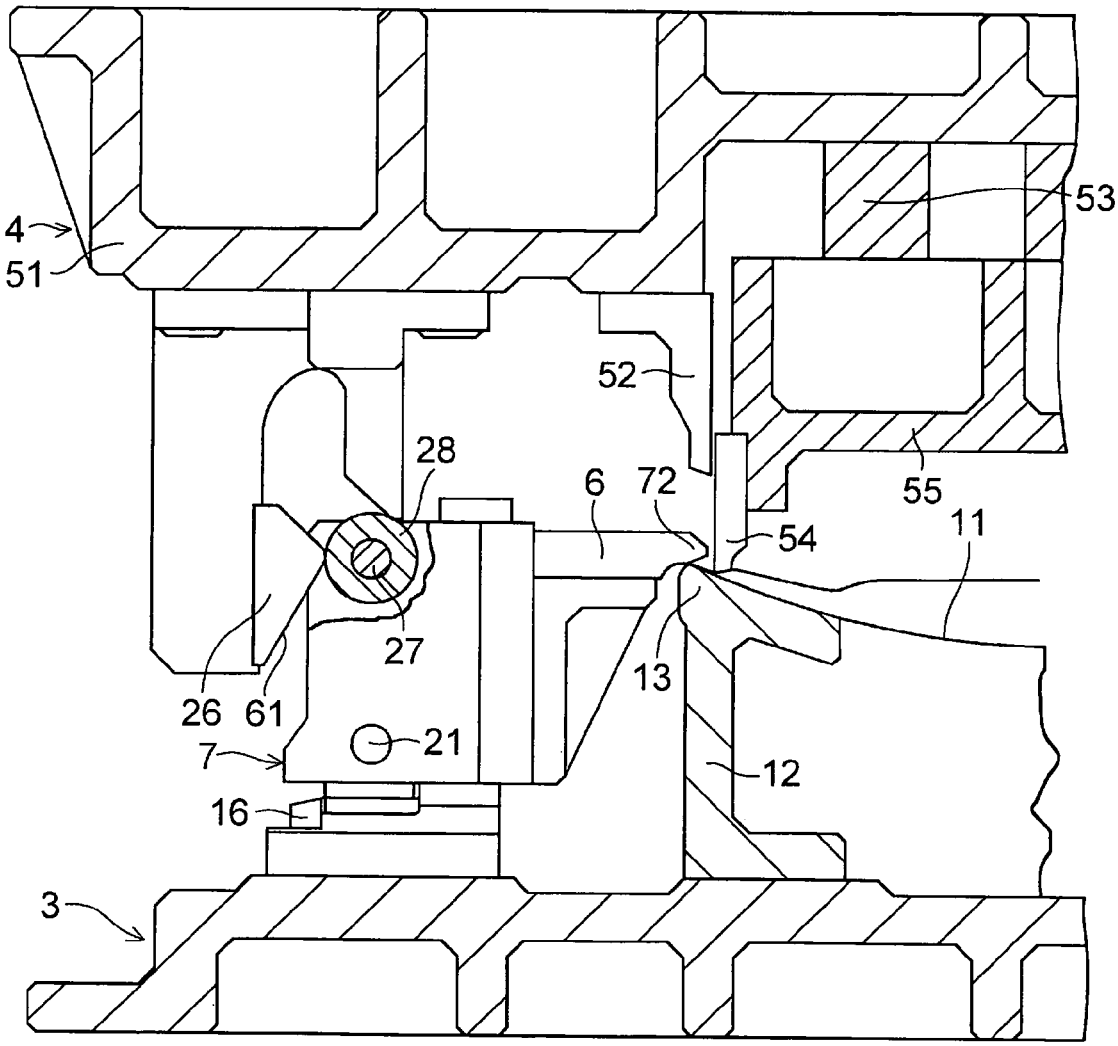
FIG. 4 is a diagram explaining the operation of the embodiment shown in FIG. 1.
Figure 5:
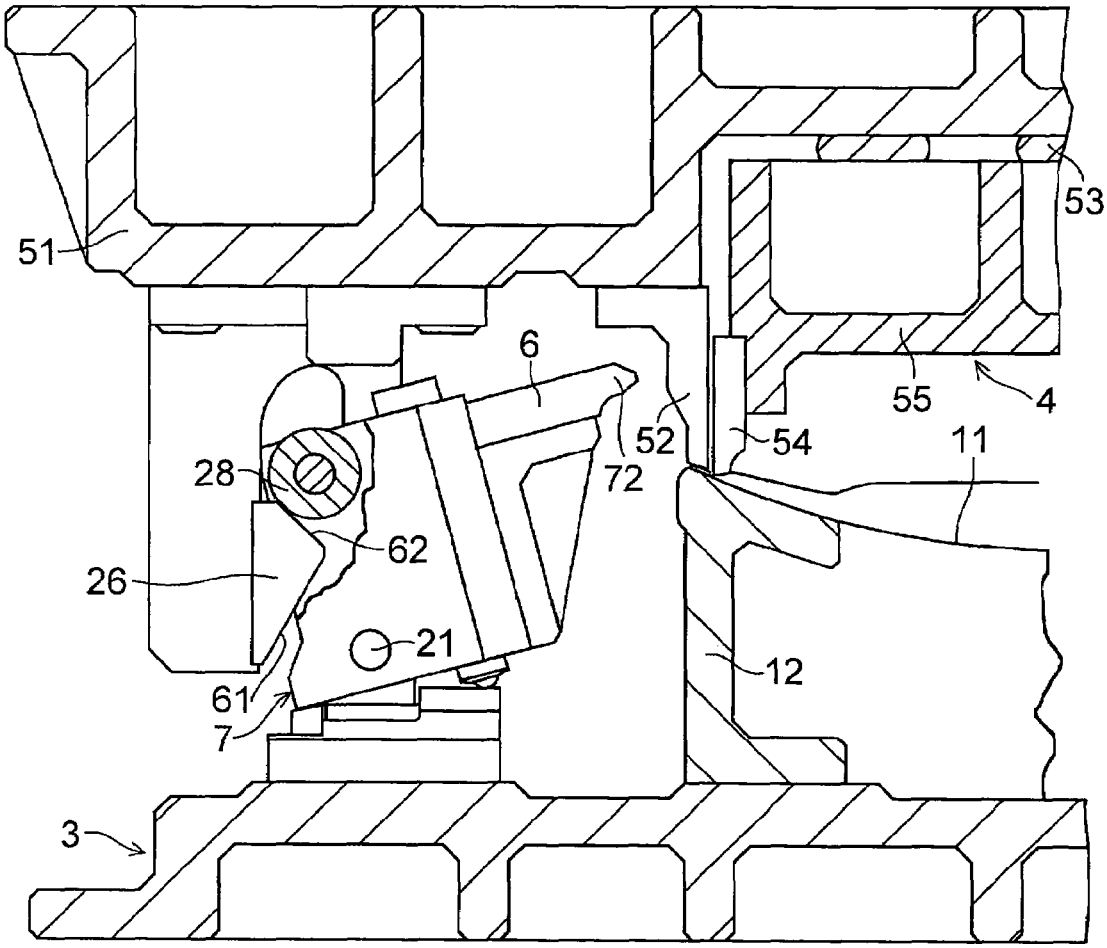
FIG. 5 is a diagram explaining the operation of the embodiment shown in FIG. 1.

In the above-described hemming apparatus 1, when the unworked plate 11 having a bent edge portion 71 to be subjected to hemming is placed on the lower die block 12, as shown in FIG. 1, the upper die 4 capable of being raised and lowered is lowered by the hydraulic ram or the like. As the upper die 4 is thus lowered, a vicinity of the bent edge portion 71 of the unworked plate 11 is resiliently pressed against and held onto the edge portion 13 by the pressing member 54 which is lowered together with the upper die block 55, as shown in FIG. 4. As the upper die 4 continues to be lowered, the cam roller 28 abuts against the inclined cam surface 61, causing the working tool holder 7 to be gradually rotated about the shaft member 21 in the A direction against the resiliency of the coil spring 41. As the working tool holder 7 is thus rotated in the A direction, a distal end portion 72 of the hemming punch 6 further bends the bent edge portion 71 of the unworked plate 11, as shown in FIG. 4. As the upper die 4 is further lowered, the cam roller 28 releases its abutment against the inclined cam surface 61 and abuts against the inclined cam surface 62, whereupon the working tool holder 7 is gradually rotated about the shaft member 21 in the B direction. As the working tool holder 7 is thus rotated in the B direction, the distal end portion 72 of the hemming punch 6 moves away from the bent edge portion 71 of the unworked plate 11, as shown in FIG. 5. Meanwhile, as the upper die 4 is lowered, the upper blade 52 presses the bent edge portion 71, thereby providing the bent edge portion 71 with final hemming. After this final hemming of the bent edge portion 71, the upper die 4 is raised by the hydraulic ram or the like, and the working tool holder 7 is thereafter operated conversely to the above-described operation by the resiliency of the coil spring 41, and is returned, as shown in FIG. 1.

According to the holder unit 2, in the through hole 25 having one end open at the upper surface 23 of the holder body 22 of the working tool holder 7 and the other end open at the lower surface 24 of the holder body 22 of the working tool holder 7, the coil spring 41 is disposed between the one end and the other end of the through hole 25. In addition, the closure plate 46 of the resiliency receiving body 42 for receiving the resiliency of the coil spring 41 is detachably fixed to the upper surface 23 of the holder body 22 of the working tool holder 7 by means of the screws 45 at the one end side of the through hole 25. Therefore, the application of the resiliency of the coil spring 41 to the spherical body 48 can be decreased by loosening the fixation of the closure plate 46 to the holder body 22 or by removing the closure plate 46 from the holder body 22 by turning the screws 45. Thus, the working tool holder 7, which has been rotated to dispose the hemming punch 6 to the nonworking position shown in FIG. 1, can be easily rotated manually to dispose the hemming punch 6 to the working position shown in FIG. 4 without being subjected to the large resistance due to the resiliency of the coil spring 41. As a result, the resiliency of the coil spring 41 can be made small without removing the coil spring 41, and it is possible to easily effect the initial adjustment and readjustment of the mutual position between the hemming punch 6 on the one hand, and the edge portion 13 of the lower die 3 and the upper blade 52 of the upper die 4 on the other hand. Furthermore, as a result of the fact that the coil spring 41 can be simply inserted into and withdrawn from the holder body 22 of the working tool holder 7, the disassembly and reassembly can be performed easily.

Figure 6:
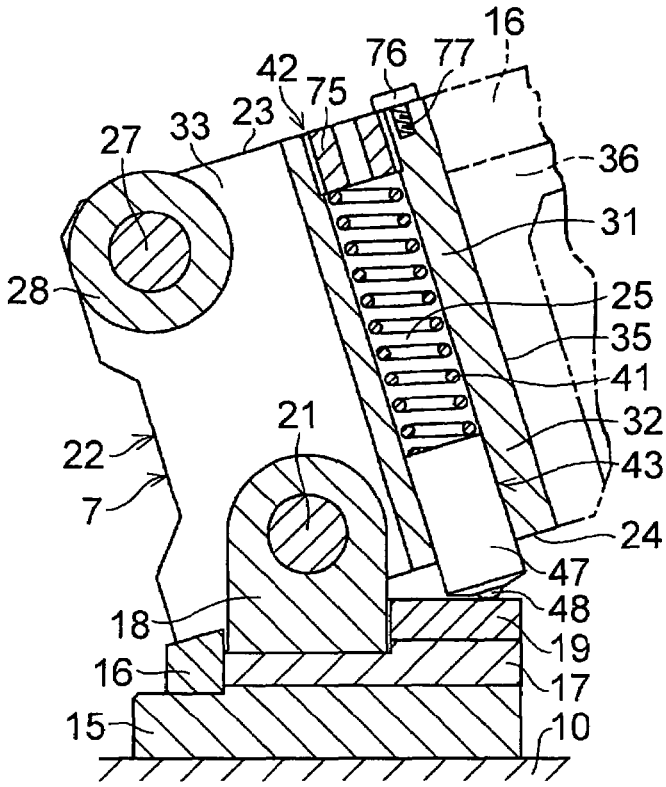
FIG. 6 is an explanatory cross-sectional view of another preferred embodiment of the holder unit in accordance with the invention.

With the above-described holder unit 2, the resiliency receiving body 42 is constructed by including the closure plate 46 attached to the upper surface 23 of the holder body 22 by means of the screws 45. Alternatively, however, as shown in FIG. 6, the resiliency receiving body 42 may be constructed by including an annular threaded plug 75 which is threadedly secured at its outer peripheral surface to the holder body 22 of the working tool holder 7 at the one end of the through hole 25. In this case, a screw 77 may be threadedly secured to the holder body 22 of the working tool holder 7 so that its enlarged head 76 engages the plug 75. The threaded plug 75 may be prevented from coming-off from the one end of the through hole 25 by means of such a screw 77.

Figure 7:
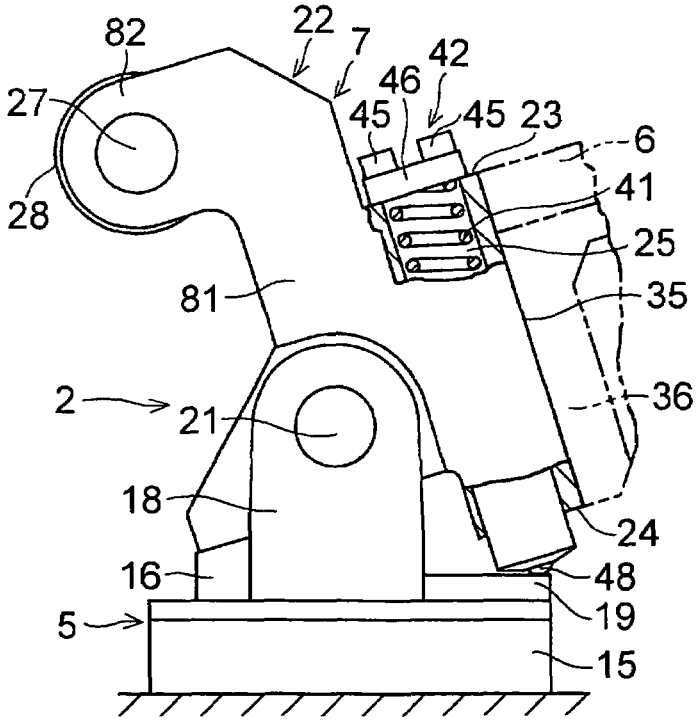
FIG. 7 is an explanatory cross-sectional view of still another preferred embodiment of the holder unit in accordance with the invention.
Figure 8:
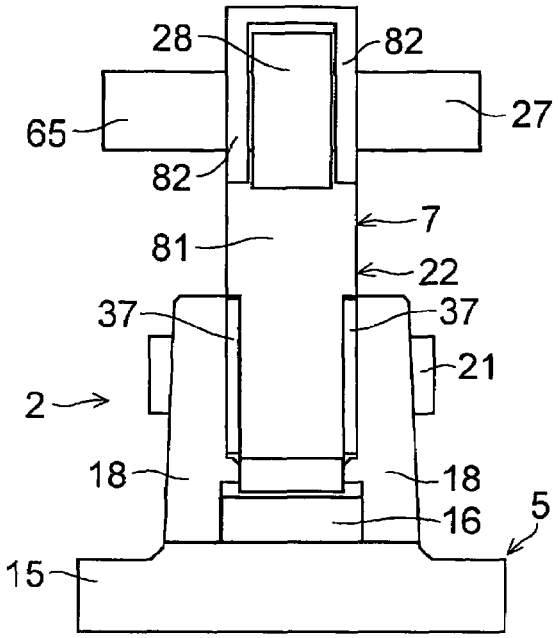
FIG. 8 is an explanatory left side view of the holder unit shown in FIG. 7.

In addition, with the holder unit 2, the base 5 is constructed by including the intermediate plate 17 and the shaft supporting member 18 disposed between the pair of side plate portions 33 and 34. Alternatively, however, as shown in FIGS. 7 and 8, the base 5 may be constructed by omitting the intermediate plate 17, by directly securing the stopper member 16 and the receiving plate 19 to the base plate 15 by bolts, welding, or the like, and by including the pair of shaft supporting members 18 directly secured to the base plate 15 by bolts, welding, or the like. In this case, the holder body 22 of the working tool holder 7 may be constructed by including a main body portion 81 disposed between the pair of shaft supporting members 18 and having the through hole 25 bored therein, as well as a pair of shaft receiving portions 82 formed integrally on the main body portion 81 and opposed to each other. With the working tool holder 7 shown in FIGS. 7 and 8, the shaft member 21 bridges the pair of shaft supporting members 18; the cam roller 28 disposed between the pair of bearing portions 82 is rotatably supported by the pair of bearing portions 82 by means of the shaft member 27; the hemming punch 6 is detachably attached to the front surface 35 of the main body portion 81 by bolts or the like; and the thrust bearing 37 is disposed between each of the pair of shaft supporting members 18 and the main body portion 81.

Also according to the above-described holder unit 2 shown in FIGS. 7 and 8, in the through hole 25 having one end open at the upper surface 23 of the holder body 22 of the working tool holder 7 and the other end open at the lower surface 24 of the holder body 22 of the working tool holder 7, the coil spring 41 is disposed between the one end and the other end of the through hole 25. In addition, the closure plate 46 of the resiliency receiving body 42 for receiving the resiliency of the coil spring 41 is detachably fixed to the upper surface 23 of the holder body 22 of the working tool holder 7 by means of the screws 45 at the one end side of the through hole 25. Therefore, the application of the resiliency of the coil spring 41 to the spherical body 48 can be decreased by loosening the fixation of the closure plate 46 to the holder body 22 or by removing the closure plate 46 from the holder body 22 by turning the screws 45. Thus, the working tool holder 7, which has been rotated to dispose the hemming punch 6 to the nonworking position shown in FIG. 1, can be rotated to dispose the hemming punch 6 to the working position shown in FIG. 4 without being subjected to the large resistance due to the resiliency of the coil spring 41. As a result, the resiliency of the coil spring 41 can be made small without removing the coil spring 41, and it is possible to easily effect the initial adjustment and readjustment of the mutual position between the hemming punch 6 on the one hand, and the edge portion 13 of the lower die 3 and the upper blade 52 of the upper die 4 on the other hand. Furthermore, as a result of the fact that the coil spring 41 can be simply inserted into and withdrawn from the holder body 22 of the working tool holder 7, the disassembly and reassembly can be performed easily.

Figure 9:
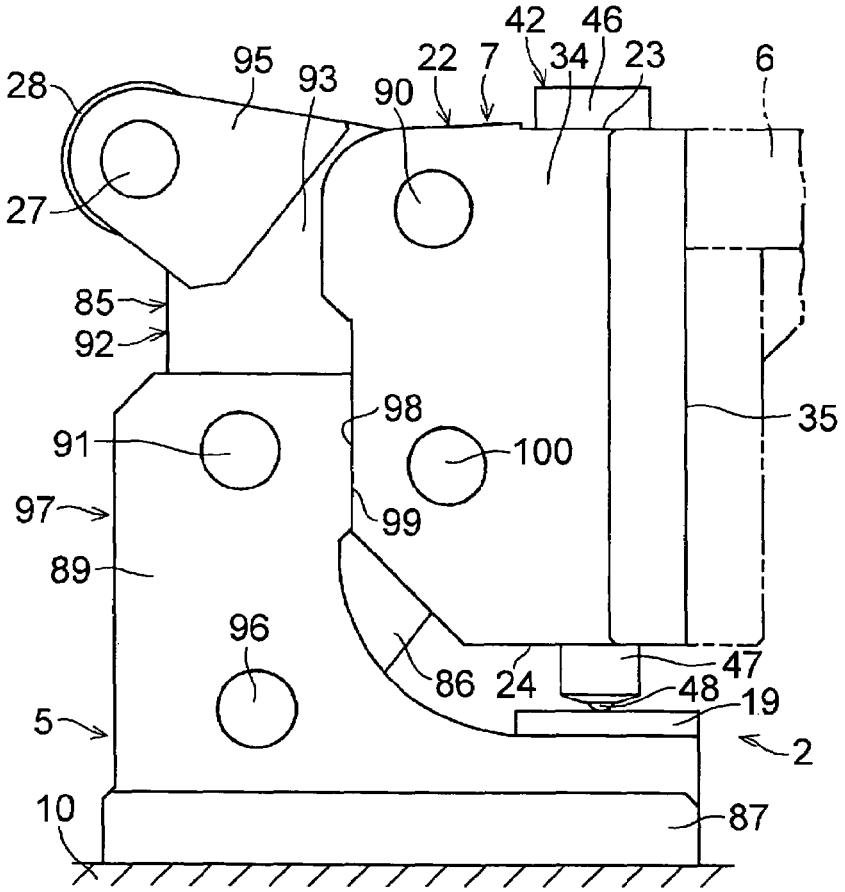
FIG. 9 is an explanatory diagram of a further preferred embodiment of the holder unit in accordance with the invention.
Figure 10:
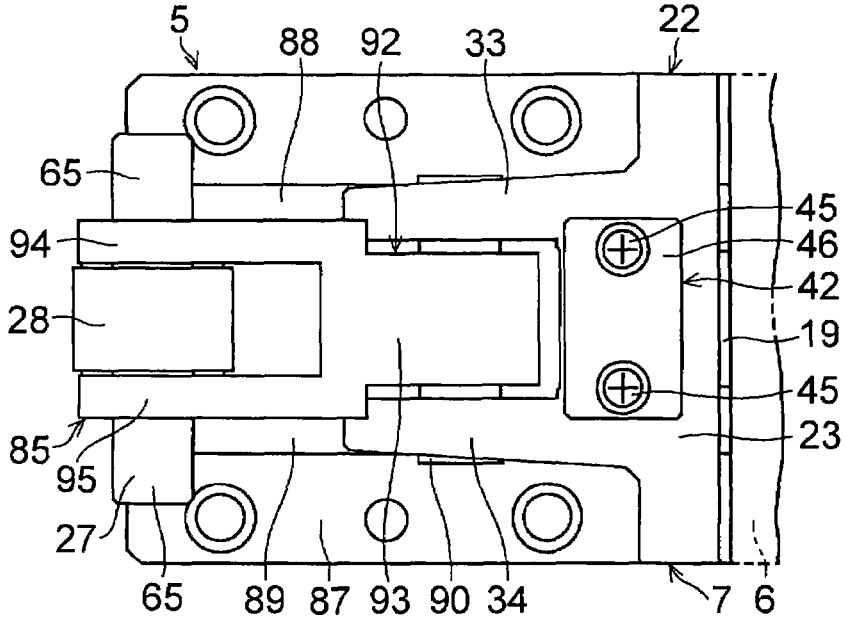
FIG. 10 is an explanatory plan view of the holder unit shown in FIG. 9.
Figure 11:
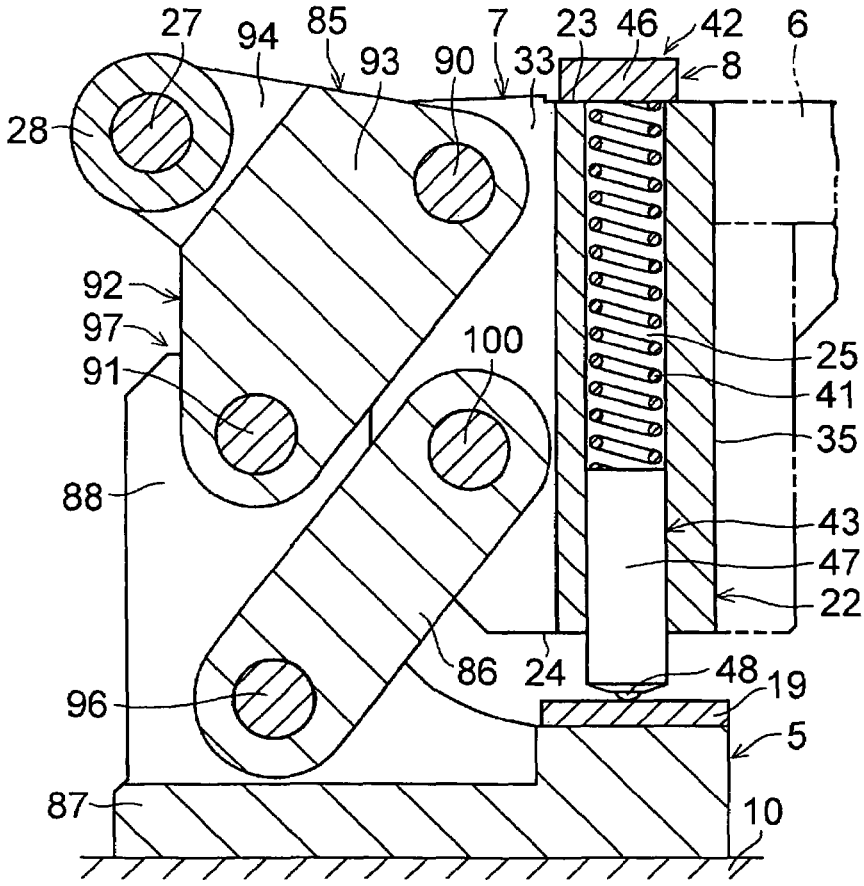
FIG. 11 is an explanatory cross-sectional view of the holder unit shown in FIG. 9.

In addition, as shown in FIGS. 9 to 11, the working tool holder 7 may include the holder body 22 which is supported on the base 5 in such a manner as to be movable in parallel by means of a pair of parallel link members 85 and 86. In this case, the base 5 includes a base portion 87 secured to the base portion 10 of the lower die 3 by bolts or the like, as well as a pair of shaft supporting portions 88 and 89 formed integrally on the base portion 87 and opposed to each other. Of the pair of parallel link members 85 and 86, one parallel link member 85 has a link body 92 having one end portion supported rotatably by the pair of side plate portions 33 and 34 of the holder body 22 by means of a shaft member 90 and the other end supported rotatably by the pair of shaft supporting portions 88 and 89 by means of a shaft member 91, as well as the cam roller 28 attached rotatably to the link body 92 by means of the shaft member 27 so as to abut against the cam driver 26 installed on the upper die 4 on lowering of the upper die 4. The link body 92 has a main body portion 93 shaped in the form of a thick-walled plate and a pair of side plate portions 94 and 95 formed integrally on the main body portion 93 in face-to-face relation with each other, and is rotatably coupled to each of the side plate portions 33 and 34 and the shaft supporting portions 88 and 89 by means of the shaft members 90 and 91 at the one end portion and the other end portion of the main body portion 93. The shaft member 27 supported by the pair of side plate portions 94 and 95 in such a manner as to bridge the pair of side plate portions 94 and 95. The cam roller 28 is disposed between the pair of side plate portions 94 and 95, and is rotatably supported by the pair of side plate portions 94 and 95 by means of the shaft member 27. The other parallel link member 86 disposed between the side plate portions 33 and 34 and between the shaft supporting portions 88 and 89 has one end portion coupled rotatably to each of the side plate portions 33 and 34 by means of a shaft member 100 and the other end portion coupled rotatably to each of the side plate portions 88 and 89 by means of a shaft member 96. Thus, the shaft supporting portions 88 and 89 of the base 5, the link body 92 of the parallel link member 85 and the parallel link member 86, and the side plate portions 33 and 34 of the holder body 22 constitute a parallel link mechanism 97 in which they are rotatably coupled to each other by means of the shaft members 90, 91, 100, and 96.

Figure 12:
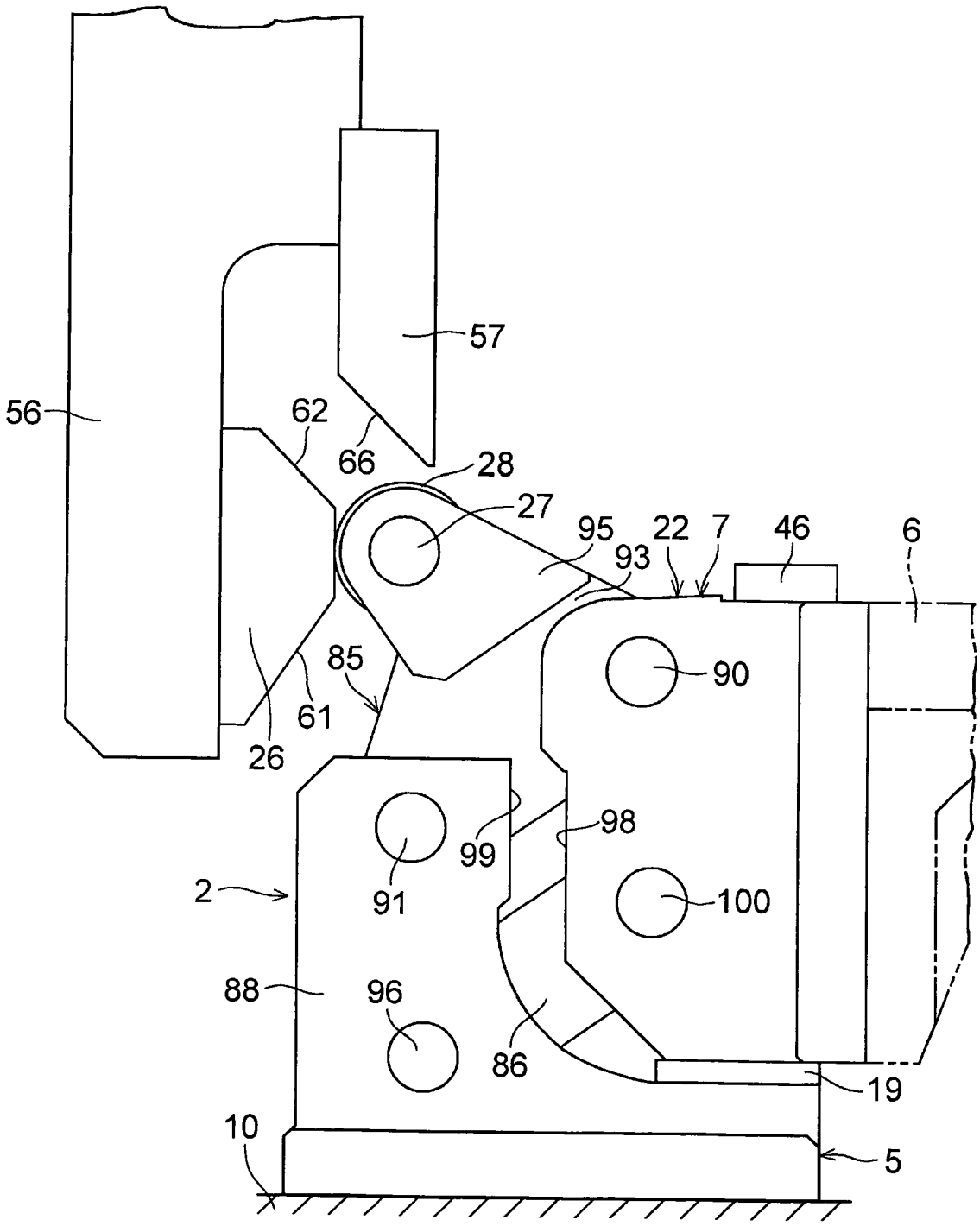
FIG. 12 is a diagram explaining the operation of the holder unit shown in FIG. 9.

With the holder unit 2 shown in FIGS. 9 to 11, the receiving plate 19 is secured to the thick-walled portion of the base portion 87 by bolts, welding, or the like. When the upper die 4 is raised, the working tool holder 7 having the hemming punch 6 mounted on the front surface 35 of the holder body 22 resiliently abuts against end faces 99 of the shaft supporting portions 88 and 89 at end faces 98 of the pair of side plate portions 33 and 34 by the resilient means 8 in which the spherical body 48 abuts against the receiving plate 19 with the resiliency of the coil spring 41. When the cam roller 28 abuts against the inclined cam surface 61 on lowering of the upper die 4 in this state, the working tool holder 7 is moved in parallel while resisting the resiliency of the coil spring 41 and being restrained by the parallel link mechanism 97 such that the end faces 98 are lowered relative to the end faces 99 while being moved away from the end faces 99. As the working tool holder 7 is thus moved in parallel, as shown in FIG. 12, the distal end portion 72 of the hemming punch 6 further bends the bent edge portion 71 of the unworked plate 11. As the upper die 4 is further lowered, the cam roller 28 releases its abutment against the inclined cam surface 61 and abuts against the inclined cam surface 62, whereupon the working tool holder 7 is moved in parallel such that the end faces 98 are raised relative to the end faces 99 while approaching the end faces 99. As the working tool holder 7 is thus moved in parallel, the distal end portion 72 of the hemming punch 6 moves away from the bent edge portion 71 of the unworked plate 11, and the bent edge portion 71 is provided with hemming in the same way as described above. After the hemming of the bent edge portion 71, the upper die 4 is raised by the hydraulic ram or the like, and the working tool holder 7 is thereafter operated conversely to the above-described operation by the resiliency of the coil spring 41, and is returned, as shown in FIG. 9.

Also according to the holder unit 2 shown in FIGS. 9 to 11, in the through hole 25 having one end open at the upper surface 23 of the holder body 22 of the working tool holder 7 and the other end open at the lower surface 24 of the holder body 22 of the working tool holder 7, the coil spring 41 is disposed between the one end and the other end of the through hole 25. In addition, the closure plate 46 of the resiliency receiving body 42 for receiving the resiliency of the coil spring 41 is detachably fixed to the upper surface 23 of the holder body 22 of the working tool holder 7 by means of the screws 45 at the one end side of the through hole 25. Therefore, the application of the resiliency of the coil spring 41 to the spherical body 48 can be decreased by loosening the fixation of the closure plate 46 to the holder body 22 or by removing the closure plate 46 from the holder body 22 by turning the screws 45. Thus, the working tool holder 7, which has been moved in parallel to dispose the hemming punch 6 to the nonworking position shown in FIG. 9, can be moved in parallel to dispose the hemming punch 6 to the working position shown in FIG. 12 without being subjected to the large resistance due to the resiliency of the coil spring 41. As a result, the resiliency of the coil spring 41 can be made small without removing the coil spring 41, and it is possible to easily effect the initial adjustment and readjustment of the mutual position between the hemming punch 6 on the one hand, and the edge portion 13 of the lower die 3 and the upper blade 52 of the upper die 4 on the other hand. Furthermore, as a result of the fact that the coil spring 41 can be simply inserted into and withdrawn from the holder body 22 of the working tool holder 7, the disassembly and reassembly can be performed easily.

The forcible-rotation guiding 57 may be mounted on the driver supporting member 56, as shown in FIG. 12.

Figure 13:
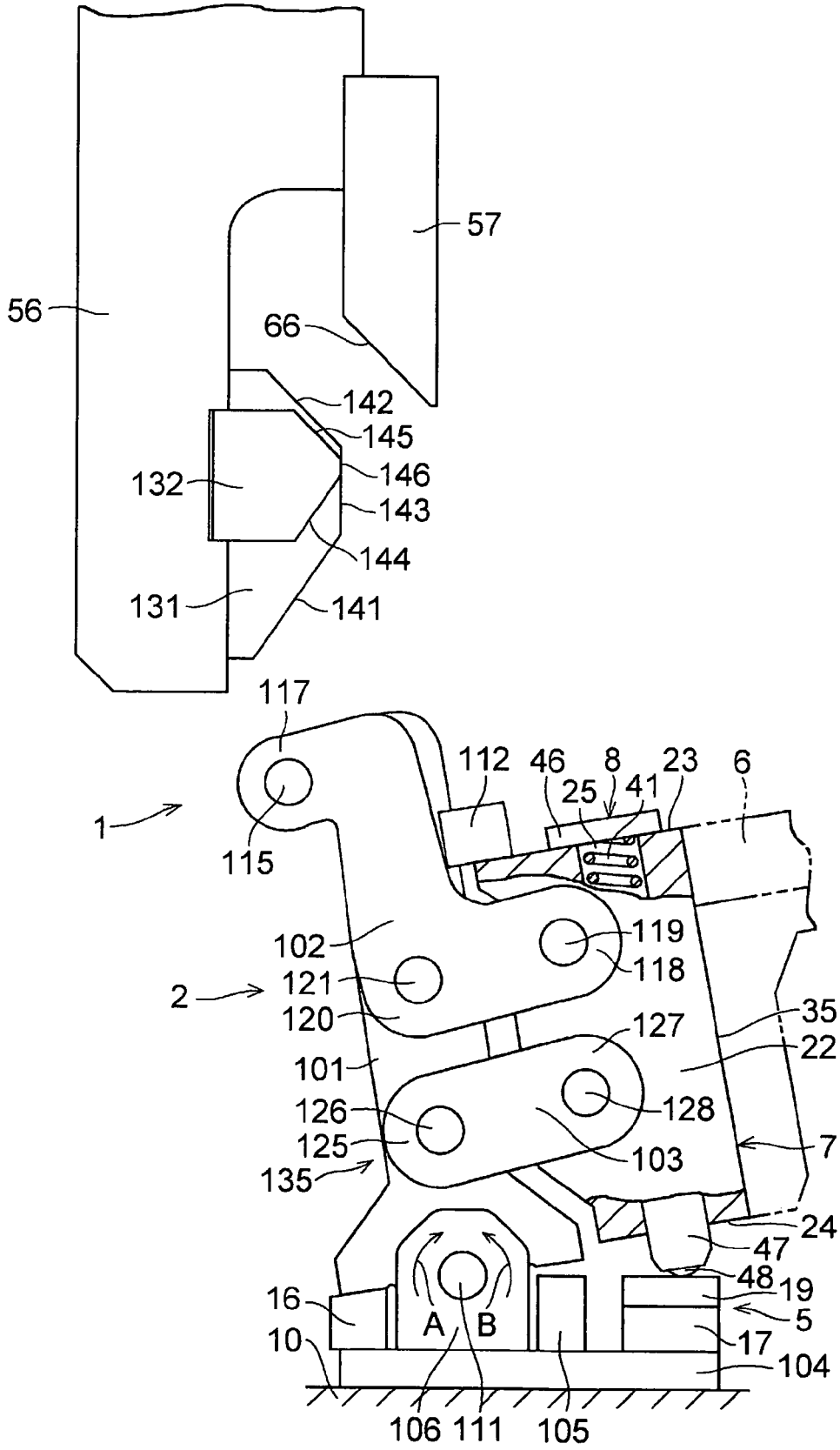
FIG. 13 is an explanatory cross-sectional view of a still further preferred embodiment of the invention.
Figure 14:
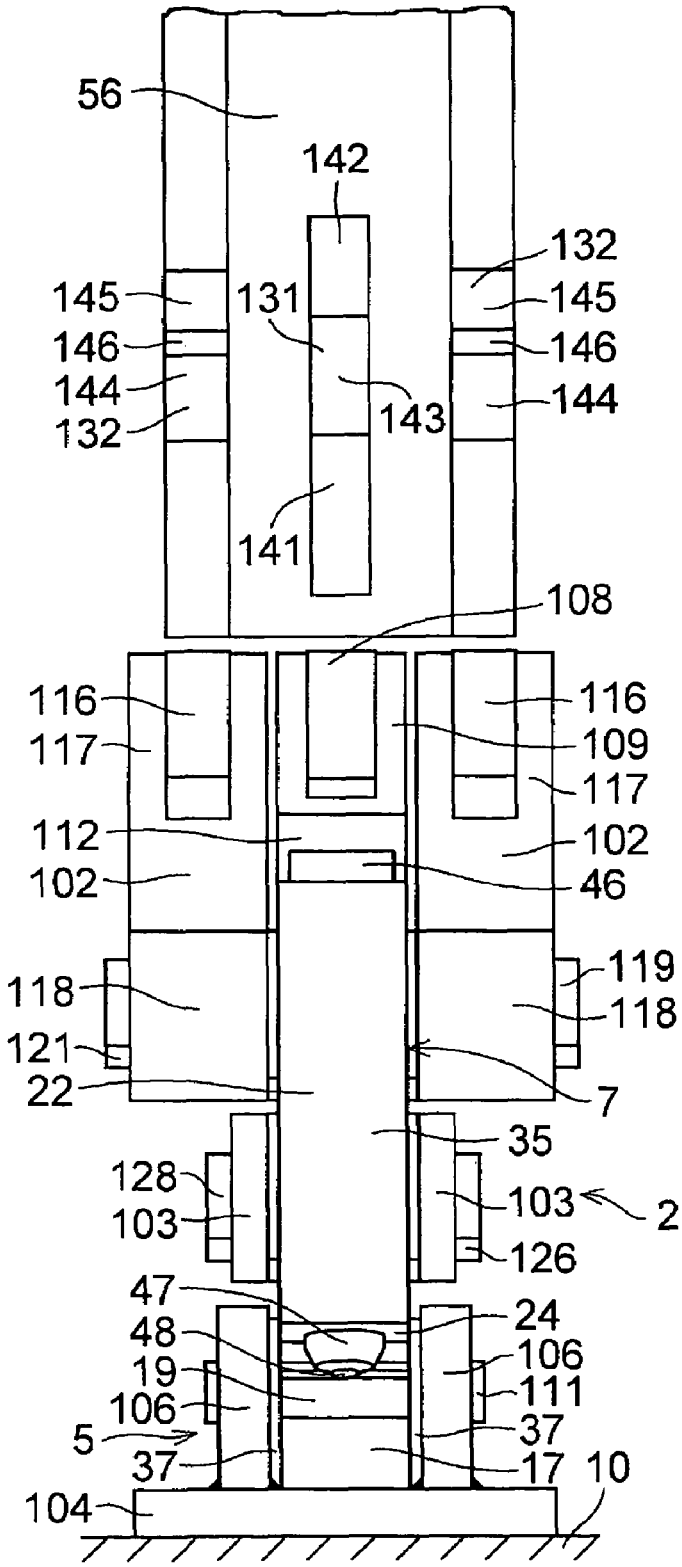
FIG. 14 is an explanatory right side view of the embodiment shown in FIG. 13.
Figure 15:
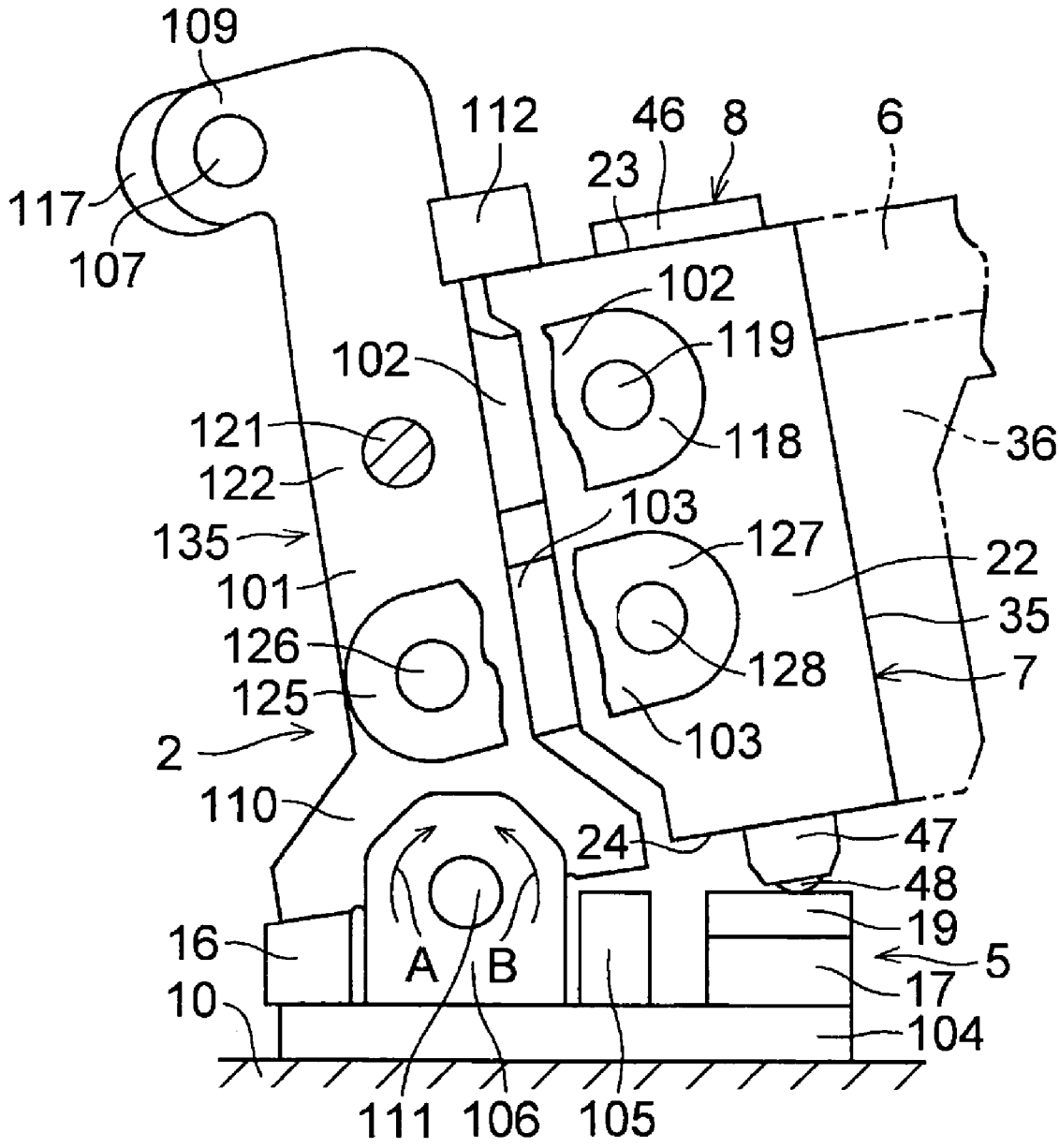
FIG. 15 is an explanatory cross-sectional view of the holder unit of the embodiment shown in FIG. 13.

It should be noted that although the above-described holder unit 2 is arranged to dispose the hemming punch 6 to the nonworking position and the working portion by rotating or moving in parallel the working tool holder 7, the holder unit 2 may alternatively be arranged to dispose the hemming punch 6 to the nonworking position and the working portion by rotating and moving in parallel the working tool holder 7, as shown in FIGS. 13 to 15.

The holder unit 2 shown in FIGS. 13 to 15 includes the base 5 secured to the base portion 10 of the lower die 3 by bolts or the like; the working tool holder 7 which is supported on the base 5 movably, i.e., rotatably in the A and B directions and movably in parallel in this embodiment, by means of a coupling column member 101 and pairs of parallel link members 102 and 103 so that the hemming punch 6 serving as a working tool to be mounted can be disposed at the nonworking position and the working position; and a transmitting body 112 which is secured to the coupling column member 101 and is interposed between the working tool holder 7 and the coupling column member 101 in such a manner as to slidably abut against the upper surface 23 of the working tool holder 7.

In the holder unit 2 shown in FIGS. 13 to 15, the base 5 includes a base portion 104 secured to the base portion 10 by bolts or the like; stopper members 16 and 105, the intermediate plate 17, and a pair of shaft supporting members 106 which are secured to the base portion 104 by bolts, welding, or the like; and the receiving plate 19 secured to the intermediate plate 17 by bolts, welding, or the like. The coupling column member 101 has a bifurcated end portion 109 for rotatably supporting a cam roller 108 by means of a shaft member 107, and is supported at its other end portion 110 by the shaft supporting member 106 rotatably in the A and B directions by means of a shaft member 111. The coupling column member 101 at its other end portion 1 10 is adapted to abut against the stopper member 105 in its rotation in the A direction and against the stopper member 16 in its rotation in the B direction. In the pairs of parallel link members 102 and 103 respectively disposed on the respective side surfaces of the working tool holder 7 and the coupling column member 101 with the working tool holder 7 and the coupling column member 101 placed therebetween, each of the parallel link members 102 has a bifurcated end portion 117 for rotatably supporting a cam roller 116 by means of a shaft member 115, and is rotatably supported at its other end portion 118 by the working tool holder 7 by means of a shaft member 119 and at its intermediate portion 120 by the coupling column member 101 by means of a shaft member 121. Each of the parallel link members 103 is rotatably supported at its one end portion 125 by the coupling column member 101 by means of a shaft member 126 and at its other end portion 127 by the working tool holder 7 by means of a shaft member 128. The working tool holder 7 has the holder body 22 constituted by a block body having the through hole 25 bored therein, and is rotatably coupled to each of the other end portions 118 and 127 of the parallel link members 102 and 103 by means of the shaft members 119 and 128 in the holder body 22. The hemming punch 6 is detachably mounted on the front surface 35 of the holder body 22 by means of the mounting tool 36 and bolts or the like.

In the case of the above-described holder unit 2 shown in FIGS. 13 to 15, the driver supporting member 56 of the upper die 4 which is capable of being raised and lowered supports a cam driver 131 which abuts against the cam roller 108 on lowering of the upper die 4, as well as a pair of cam drivers 132 which similarly abut against the cam rollers 116, respectively, on lowering of the upper die 4. The cam driver 131 has inclined cam surfaces 141 and 142 and a vertical cam surface 143 disposed between the inclined cam surfaces 141 and 142. Each of the cam drivers 132 has inclined cam surfaces 144 and 145 having distances shorter than those of the inclined cam surfaces 141 and 142, as well as a vertical cam surface 146 which is disposed between the inclined cam surfaces 144 and 145, is flush with the vertical cam surface 143, and has a distance shorter than that of the vertical cam surface 143.

It should be noted that in a case where the cam rollers 108 and 116 fail to be guided by and abut against the inclined cam surfaces 142 and 145 by the resiliency of the coil spring 41 due to some cause or other, the cam rollers 116 may be abutted against the inclined cam surfaces 66 of the forcible-rotation guiding member 57 attached to the driver supporting member 56 to forcibly effect the same.

In the above-described manner, the holder body 22 has the through hole 25 and is supported on the base 5 rotatably in the A and B directions and movably in parallel by means of the coupling column member 101 and the pairs of parallel link members 102 and 103. The coupling column member 101 is coupled to the base 5 rotatably in the A and B directions by means of the shaft member 111. The pairs of the parallel link members 102 and 103 are rotatably coupled to the holder body 22 of the working tool holder 7 and the coupling column member 101 by means of the shaft members 119, 121, 126, and 128, respectively. The coupling column member 101 and the parallel link members 102 respectively have the cam rollers 108 and 116 which abut against the respective ones of the inclined cam surfaces 141 and 142 and the vertical cam surface 143 of the cam driver 131 as well as the inclined cam surfaces 144 and 145 and the vertical cam surface 146 of the cam drivers 132 on lowering of the upper die 4.

In the holder unit 2 shown in FIGS. 13 to 15, the holder body 22 of the working tool holder 7, the coupling column member 101, and the pairs of parallel link members 102 and 103 constitute a parallel link mechanism 135 in which they are rotatably coupled to each other by means of the shaft members 119, 121, 126, and 128.

Figure 16:
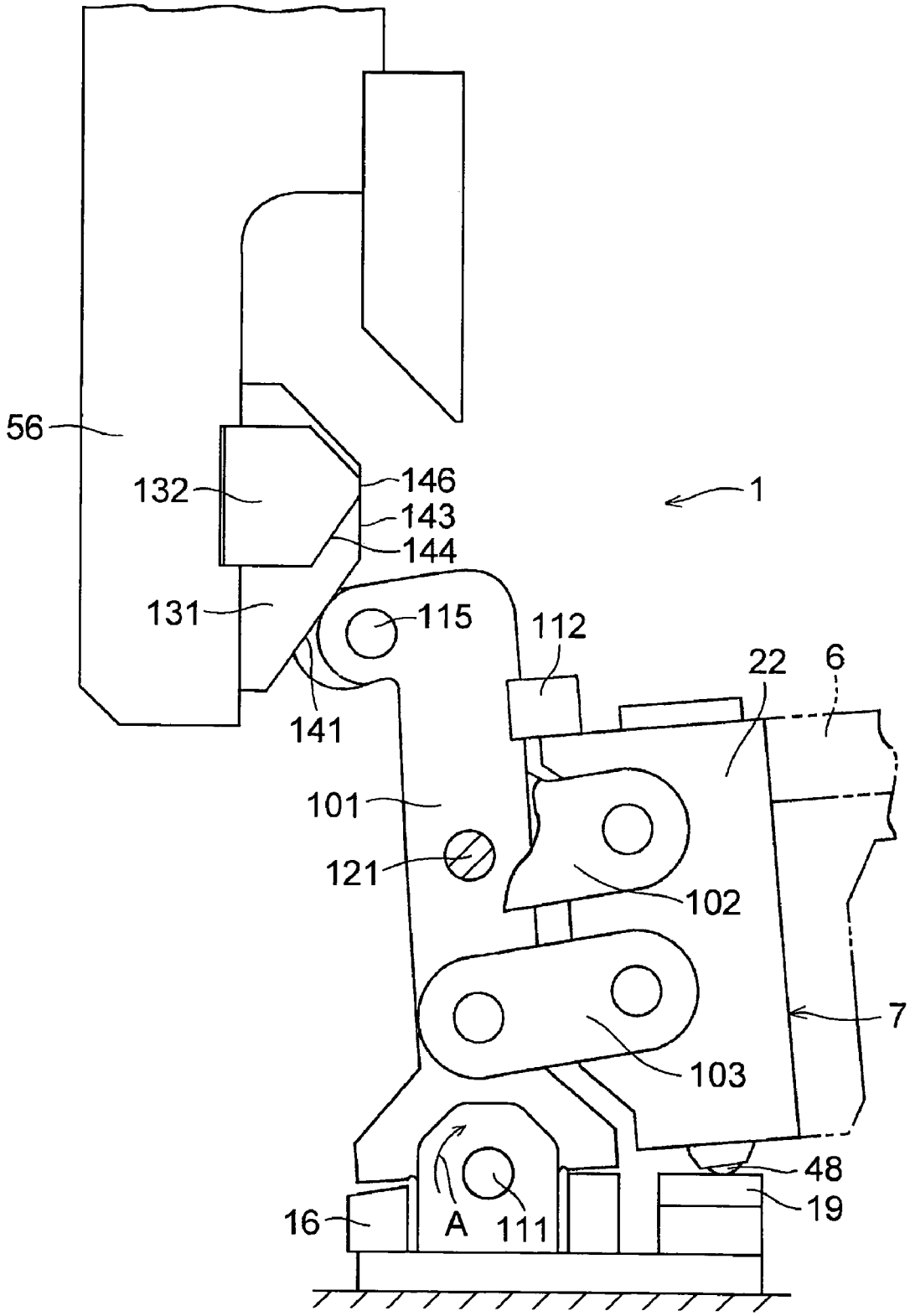
FIG. 16 is a diagram explaining the operation of the embodiment shown in FIG. 13.
Figure 17:
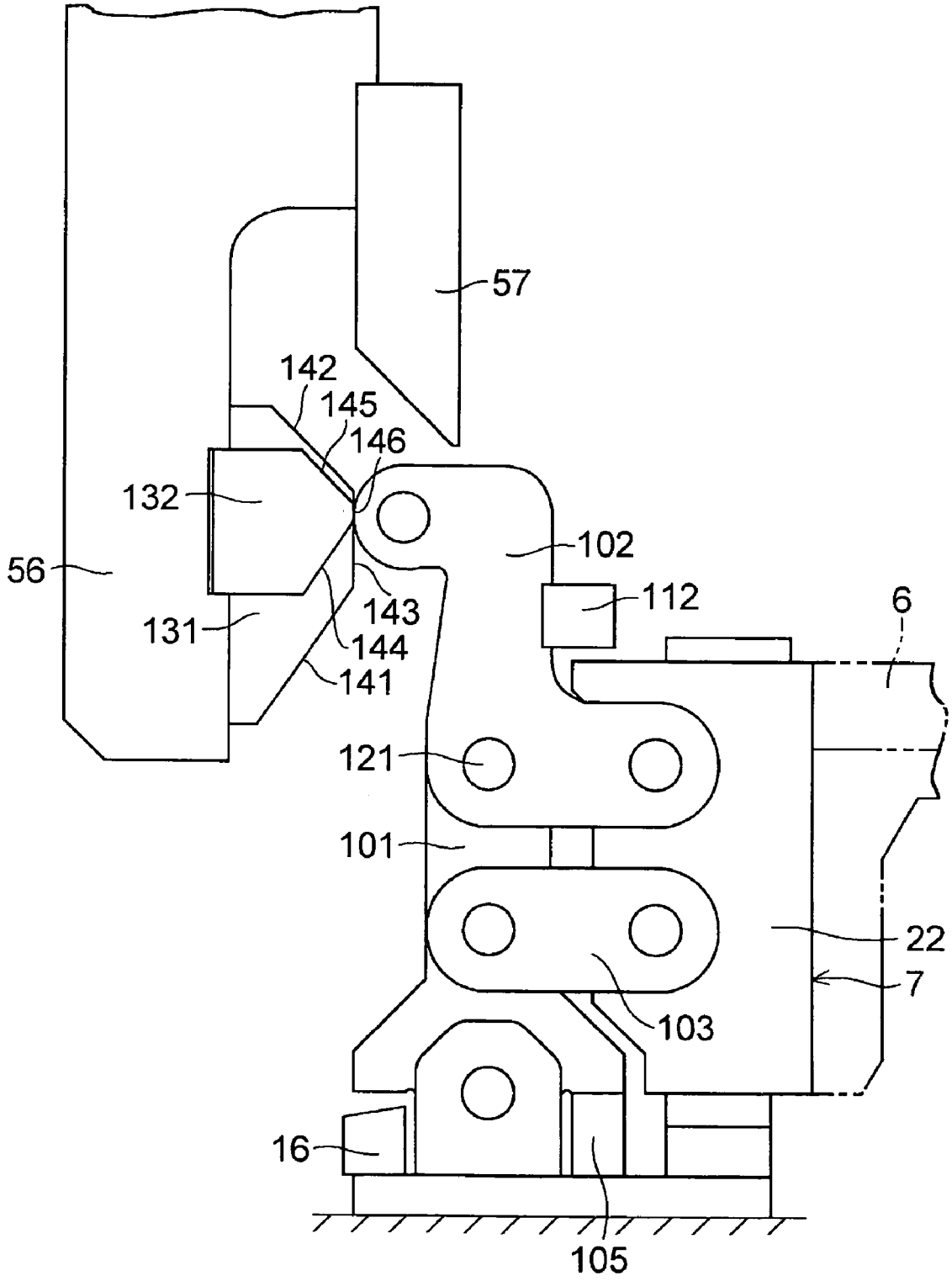
FIG. 17 is a diagram explaining the operation of the embodiment shown in FIG. 13.

In the hemming apparatus 1 using the holder unit 2 shown in FIGS. 13 to 15, after a vicinity of the bent edge portion 71 of the unworked plate 11 is resiliently pressed against and held onto the edge portion 13 by the pressing member 54, the upper die 4 continues to be lowered, and the cam roller 108 abuts against the inclined cam surface 141 of the cam driver 131. Then, the coupling column member is gradually rotated about the shaft member 111 in the A direction against the resiliency of the coil spring 41, as shown in FIG. 16. As the coupling column member 101 is thus rotated in the A direction, the holder body 22 of the working tool holder 7 is also rotated in the A direction by means of the transmitting body 112 and the pairs of parallel link members 102 and 103. When the cam rollers 116 then start to abut against the inclined cam surfaces 144 of the cam drivers 132 on further lowering of the upper die 4, the parallel link members 102 are rotated about the shaft member 121 relative to the coupling column member 101. As the parallel link members 102 are thus rotated, the holder body 22 of the working tool holder 7 is moved in parallel. The distal end portion 72 of the hemming punch 6 further bends the bent edge portion 71 of the unworked plate 11 by such rotation in the A direction and parallel movement of the working tool holder 7. Thereafter, after the bent edge portion 71 is finally hemmed by the upper blade 52 in the same way as described above by the abutment of the cam roller 108 against the vertical cam surface 143 and the abutment of the cam rollers 116 against the vertical cam surfaces 146, as shown in FIG. 17, the upper die 4 is raised by the hydraulic ram or the like, and the working tool holder 7 is operated conversely by the resiliency of the coil spring 41, and is returned, as shown in FIG. 13.

Also with the holder unit 2 shown in FIGS. 13 to 15, in the through hole 25 having one end open at the upper surface 23 of the holder body 22 of the working tool holder 7 and the other end open at the lower surface 24 of the holder body 22 of the working tool holder 7, the coil spring 41 is disposed between the one end and the other end of the through hole 25. In addition, the closure plate 46 of the resiliency receiving body 42 for receiving the resiliency of the coil spring 41 is detachably fixed to the upper surface 23 of the holder body 22 of the working tool holder 7 by means of the screws 45 at the one end side of the through hole 25. Therefore, the application of the resiliency of the coil spring 41 to the spherical body 48 can be decreased by loosening the fixation of the closure plate 46 to the holder body 22 or by removing the closure plate 46 from the holder body 22 by turning the screws 45. Thus, the working tool holder 7, which has been rotated to dispose the hemming punch 6 to the nonworking position shown in FIG. 13, can be rotated to dispose the hemming punch 6 to the working position shown in FIG. 17 without being subjected to the large resistance due to the resiliency of the coil spring 41. As a result, the resiliency of the coil spring 41 can be made small without removing the coil spring 41, and it is possible to easily effect the initial adjustment and readjustment of the mutual position between the hemming punch 6 on the one hand, and the edge portion 13 of the lower die 3 and the upper blade 52 of the upper die 4 on the other hand. Furthermore, as a result of the fact that the coil spring 41 can be simply inserted into and withdrawn from the holder body 22 of the working tool holder 7, the disassembly and reassembly can be performed easily.

The invention claimed is:

1. A holder unit comprising: a base; a working tool holder which is movably supported on said base so that a working tool to be mounted can be disposed at a nonworking position and a working position; and resilient structure to resiliently urge said working tool holder so as to dispose the working tool at the nonworking position, wherein said working tool holder is provided with a through hole having one end open at one end surface of said working tool holder and another end open at another end surface of said working tool holder, and said resilient structure includes a resilient body disposed between the one end and the other end of the through hole, a resiliency receiving body which is detachably fixed to said working tool holder at one end side of the through hole and receives the resiliency of said resilient body, and an abutment body which is movably disposed in said working tool holder at another end side of the through hole, and which is adapted to abut against said base by the resiliency from said resilient body, said abutment body having one of a cylindrical body and a hollow cylindrical body which is movably disposed in said working tool holder at the other end side of the through hole and a rotating body which is rotatably held by said one of said cylindrical body and said hollow cylindrical body and rolls on and abuts against said base.

2. The holder unit according to claim 1, wherein said resiliency receiving body has a threaded plug which is threadedly secured to said working tool holder at the one end of the through hole.

3. The holder unit according to claim 2, further comprising: a screw threadedly secured to said working tool holder so as to prevent said threaded plug from coming off the one end of the through hole.

4. The holder unit according to claim 1, wherein said resiliency receiving body has a closure plate attached to the one end face of said working tool holder by means of a screw so as to close the one end of the through hole.

5. The holder unit according to claim 1, wherein said rotating body is constituted by one of a spherical body and a roller which is rotatably held by said one of said cylindrical body and said hollow cylindrical body.

6. The holder unit according to claim 1, wherein said working tool holder includes a holder body which has the through hole and is rotatably supported on said base by means of a shaft member, and a cam roller attached to said holder body so as to abut against a cam driver.

7. The holder unit according to claim 1, wherein said working tool holder includes a holder body which has the through hole and is supported on said base in such a manner as to be movable in parallel by means of a pair of parallel link members, and one of said pair of parallel link members has a link body and a cam roller attached to said link body so as to abut against a cam driver.

8. The holder unit according to claim 7, wherein said base, said link body, and another one of said pair of parallel link members, and said holder body constitute a parallel link mechanism.

9. The holder unit according to claim 1, wherein said working tool holder has the through hole and is supported on said base rotatably and movably in parallel by means of a coupling column member and a pair of parallel link members, said coupling column member being rotatably coupled to said base by means of a shaft member, each of said pair of parallel link members being rotatably coupled to respective ones of said working tool holder and said coupling column member, respective ones of said coupling column member and one of said pair of parallel link members having cam rollers which respectively abut against cam drivers.

10. The holder unit according to claim 9, wherein said working tool holder, said coupling column member, and said pair of parallel link members constitute a parallel link mechanism.

11. The holder unit according to claim 9, further comprising a transmitting body interposed between said working tool holder and said coupling column member so as to transmit to said working tool holder the rotation of said coupling column member for disposing the working tool at the working position and to transmit to said coupling column member the rotation of said working tool holder by said resilient structure for disposing the working tool to the nonworking position.

12. The holder unit according to claim 11, wherein said transmitting body is secured to said coupling column member and slidably abuts against said working tool holder.

13. The holder unit according to claim 1, wherein said resilient body has at least one of a coil spring, urethane rubber, and a gas spring.

14. The holder unit according to claim 1, wherein said resilient body has a coil spring.

15. A hemming apparatus comprising the holder unit According to claim 1.

16. A holder unit comprising: a base; a working tool holder which is movably supported on said base so that a working tool to be mounted can be disposed at a nonworking position and a working position; and resilient structure to resiliently urge said working tool holder so as to dispose the working tool at the nonworking position, wherein said working tool holder is provided with a through hole having one end open at one end surface of said working tool holder and another end open at another end surface of said working tool holder, and said resilient structure includes a resilient body disposed between the one end and the other end of the through hole, a resiliency receiving body which is detachably fixed to said working tool holder at one end side of the through hole and receives the resiliency of said body, and an abutment body which is movable disposed in said working tool holder at another end side of the through hole, and which is adapted to abut against said base by the resiliency from said resilient body, said working tool holder including a holder body which has the through hole and is rotatable supported on said base by means of a shaft member, and a cam roller attached to said holder body so as to abut against a cam driver.

17. The holder unit according to claim 16, wherein said resiliency receiving body has a threaded plug which is threaded secured to said working tool holder at the one end of the through hole.

18. The holder unit according to claim 17, further comprising: a screw threadedly secured to said working tool holder so as to prevent said threaded plug from coming off the end of the through hole.

19. The holder unit according to claim 16, wherein said resiliency receiving body has a closure plate attached to the one end face of said working tool holder by means of a screw so as to close the one end of the through hole.

20. The holder unit according to claim 16, wherein said abutment body has one of a cylindrical body and a hollow cylindrical body which is movably disposed in said working tool holder at the other end side of the through hole and a sliding body which is integrally provided on said one of said cylindrical body and said hollow cylindrical body and slidably abuts against said base.

21. The holder unit according to claim 16, wherein said abutment body has one of a cylindrical body and a hollow cylindrical body which is movably disposed in said working tool holder at the other end side of the through hole and a rotating body which is rotatably held by said one of said cylindrical body and said hollow cylindrical body and rolls on and abuts against said base, said rotating body being constituted by one of a spherical body and a roller which is rotatably held by said one of said cylindrical body and said hollow cylindrical body.

22. The holder unit according to claim 16, wherein said resilient body has at least one of a coil spring, urethane rubber, and a gas spring.

23. The holder unit according to claim 16, wherein said resilient body has a coil spring.

24. A hemming apparatus comprising the holder unit according to claim 16.

25. A holder unit comprising: a base; a working tool holder which is movably supported on said base so that a working tool to be mounted can be disposed at a nonworking position and a working position; and resilient structure to resiliently urge said working tool holder so as to dispose the working tool at the nonworking position, wherein said working tool holder is provided with a through hole having one end open at one end surface of said working tool holder and another end open at another end surface of said working tool holder, and said resilient structure includes a resilient body disposed between the one end and the other end of the through hole, a resiliency receiving body which is detachably fixed to said working tool holder at one end side of the through hole and receives the resiliency of said resilient body, and an abutment body which is movably disposed in said working tool holder at another end side of the through hole, and which is adapted to abut against said base by the resiliency from said resilient body, said working tool holder including a holder body which has the through hole and is supported on said base in such a manner as to be movable in parallel by means of a pair of parallel link members, and one of said pair of parallel link members has a link body and a cam roller attached to said link body so as to abut against a cam driver.

26. The holder unit according to claim 25, wherein said resiliency receiving body has a threaded plug which is threadedly secured to said working tool holder at the one end of the through hole.

27. The holder unit according to claim 26, further comprising: a screw threadedly secured to said working tool holder so as to prevent said threaded plug from coming off the one end of the through hole.

28. The holder unit according to claim 25, wherein said resiliency receiving body has a closure plate attached to the one end face of said working tool holder by means of a screw so as to close the one end of the through hole.

29. The holder unit according to claim 25, wherein said abutment body has one of a cylindrical body and a hollow cylindrical body which is movably disposed in said working tool holder at the other end side of the through hole and a sliding body which is integrally provided on said one of said cylindrical body and said hollow cylindrical body and slidably abuts against said base.

30. The holder unit according to claim 25, wherein said abutment body has one of a cylindrical body and a hollow cylindrical body which is movably disposed in said working tool holder at the other end side of the through hole and a rotating body which is rotatably held by said one of said cylindrical body and said hollow cylindrical body and rolls on and abuts against said base, said rotating body being constituted by one of a spherical body and a roller which is rotatably held by said one of said cylindrical body and said hollow cylindrical body.

31. The holder unit according to claim 25, wherein said base, said link body, another one of said pair of parallel link members, and said holder body constitute a parallel link mechanism.

32. The holder unit according to claim 25, wherein said resilient body has at least one of a coil spring, urethane rubber, and a gas spring.

33. The holder unit according to claim 25, wherein said resilient body has a coil spring.

34. A hemming apparatus comprising the holder unit according to claim 25.

35. A holder unit comprising: a base; a working tool holder which is movably supported on said base so that a working tool to be mounted can be disposed at a nonworking position and a working position; and resilient structure to resiliently urge said working tool holder so as to dispose the working tool at the nonworking position, wherein said working tool holder is provided with a through hole having one end open at one end surface of said working tool holder and another end open at another end surface of said working tool holder, and said resilient structure includes a resilient body disposed between the one end and the other end of the through hole, a resiliency receiving body which is detachably fixed to said working tool holder at one end side of the through hole and receives the resiliency of said resilient body, and an abutment body which is movably disposed in said working tool holder at another end side of the through hole, and which is adapted to abut against said base by the resiliency from said resilient body, said working tool holder having the through hole and being supported on said base rotatably and movably in parallel by means of a coupling column member and a pair of parallel link members, said coupling column member being rotatably coupled to said base by means of a shaft member, each of said pair of parallel link members being rotatably coupled to respective ones of said working tool holder and said coupling column member, respective ones of said coupling column member and one of said pair of parallel link members having cam rollers which respectively abut against cam drivers.

36. The holder unit according to claim 35, wherein said resiliency receiving body has a threaded plug which is threadedly secured to said working tool holder at the one end of the through hole.

37. The holder unit according to claim 36, further comprising: a screw threadedly secured to said working tool holder so as to prevent said threaded plug from coming off the one end of the through hole.

38. The holder unit according to claim 35, wherein said resiliency receiving body has a closure plate attached to the one end face of said working tool holder by means of a screw so as to close the one end of the through hole.

39. The holder unit according to claim 35, wherein said abutment body has one of a cylindrical body and a hollow cylindrical body which is movably disposed in said working tool holder at the other end side of the through hole and a sliding body which is integrally provided on said one of said cylindrical body and said hollow cylindrical body and slidably abuts against said base.

40. The holder unit according to claim 35, wherein said abutment body has one of a cylindrical body and a hollow cylindrical body which is movably disposed in said working tool holder at the other end side of the through hole and a rotating body which is rotatably held by said one of said cylindrical body and said hollow cylindrical body and rolls on and abuts against said base, said rotating body being constituted by one of a spherical body and a roller which is rotatably held by said one of said cylindrical body and said hollow cylindrical body.

41. The holder unit according to claim 35, wherein said working tool holder, said coupling column member, and said pair of parallel link members constitute a parallel link mechanism.

42. The holder unit according to claim 35, further comprising a transmitting body interposed between said working tool holder and said coupling column member so as to transmit to said working tool holder the rotation of said coupling column member for disposing the working tool at the working position and to transmit to said coupling column member the rotation of said working tool holder by said resilient structure for disposing the working tool to the nonworking position.

43. The holder unit according to claim 42, wherein said transmitting body is secured to said coupling column member and slidably abuts against said working tool holder.

44. The holder unit according to claim 35, wherein said resilient body has at least one of a coil spring, urethane rubber, and a gas spring.

45. The holder unit according to claim 35, wherein said resilient body has a coil spring.

46. A hemming apparatus comprising the holder unit according to claim 35.

* * * * *

UNITED STATES PATENT AND TRADEMARK OFFICE

CERTIFICATE OF CORRECTION

PATENT NO. : 7,640,779 B2
APPLICATION NO. : 10/549446
DATED : January 5, 2010
INVENTOR(S) : Tadashi Sasahara It is certified that error appears in the above-identified patent and that said Letters Patent is hereby corrected as shown below:

Column 14, line 30 (claim 18), change "the end of" to "the one end of."

Signed and Sealed this

Eleventh Day of May, 2010

David J. Kappos

David J. Kappos
*Director of the United States Patent and Trademark Office*